US006571167B2

(12) United States Patent
Schmidt

(10) Patent No.: US 6,571,167 B2
(45) Date of Patent: May 27, 2003

(54) AIRPORT TAKEOFF WINDOW

(75) Inventor: Harry P Schmidt, Cromwell, CT (US)

(73) Assignee: AeroAnalysis, Inc., Cromwell, CT (US)

( * ) Notice: Subject to any disclaimer, the term of this patent is extended or adjusted under 35 U.S.C. 154(b) by 0 days.

(21) Appl. No.: 09/951,559

(22) Filed: Sep. 14, 2001

(65) Prior Publication Data

US 2002/0077743 A1 Jun. 20, 2002

Related U.S. Application Data

(60) Provisional application No. 60/232,844, filed on Sep. 15, 2000.

(51) Int. Cl.[7] ..... G06G 7/76

(52) U.S. Cl. ..... 701/120; 340/959; 340/961; 342/29

(58) Field of Search ..... 701/11, 117, 118, 701/120; 340/947, 933, 959, 961; 342/29, 32, 36

(56) References Cited

U.S. PATENT DOCUMENTS 5,426,429 A * 6/1995 Norman et al. ..... 340/953
6,282,488 B1 * 8/2001 Castor et al. ..... 701/120

* cited by examiner

*Primary Examiner*—Yonel Beaulieu
(74) *Attorney, Agent, or Firm*—Nixon Peabody LLP; Tim L. Brackett, Jr.

(57) ABSTRACT

An airport control system including a sensing mechanism for sensing a plurality of target conditions, a processing mechanism electronically connected to the sensing mechanism for calculating an optimum time to initiate a takeoff sequence based upon the target conditions, a status indicator for providing runway status information, and a control mechanism in electronic communication with the calculating mechanism and the status indicator for controlling the operation of the status indicator in response to receiving the optimum time.

27 Claims, 8 Drawing Sheets

AIRPORT TAKEOFF WINDOW

BACKGROUND OF THE INVENTION

1. Field of the Invention

The present invention is directed to a system of controlling aircraft and ground traffic at and near airports.

2. Description of the Related Art

As airport and air traffic congestion become recognized as seriously threatening the future of our aviation transportation system, it is clear that both safety and capacity will receive equal recognition as primarily system design criteria. Runway incursions, defined as any occurrence at an airport involving an aircraft, vehicle, persons, or object on the ground that creates a collision hazard or results in loss of separation with an aircraft taking off, intending to take off, landing or intending to land. It can be said that runway incursions directly impact airport capacity and airport safety.

The problem of reduced airport capacity and reduced airport safety stems primarily from the fact that a majority of airport operations are manually controlled by the control towers, the cockpits, and the radar rooms. There exist a number of human factor considerations which impact airport capacity, such as variable airport controller capability, variable landing intervals, variable pilot response, variable pilot procedures, pilot response in landing on a crossing runway and runway design.

Regarding variable airport controller capability, controllers have different capabilities in handling landings and takeoffs. This difference is more noticeable at airports which experience high demand rates and complex flight situations. With variable landing intervals, differences in personnel capability and procedures lead to significant variation in intervals between landings. Therefore, each landing interval must be appraised on an individual basis, and the opportunity to permit a takeoff between two landings is unique to the controller.

With regard to variable pilot response, studies show that pilots react differently to instructions from the controller. Consequently, any perceived delay to takeoff (controllers will typically associate a quick or delayed response to certain types of aircraft and airlines) must be considered by the controller in any decision to permit a takeoff between landings, or require a hold until a later time. In terms of variable pilot procedures, procedures for initiating takeoff vary between airlines, and thus, the controller must react to a perceived slow reaction or delay by a pilot. Studies further show that, even though the controller may authorize an aircraft for takeoff, pilots are often reluctant to initiate takeoff before an inbound aircraft has traversed the intersection. The unwillingness to initiate takeoff is directly related to the distance between takeoff point and the intersection, and either decreases safety margins or decreases airport capacity.

Moreover, adverse weather, reduced visibility, radio frequency congestion, language ambiguities, and other real-world occurrences add another dimension to the aircraft control problem reducing control effectiveness below the desired level of excellence.

In response to the need to enhance airport safety, there has been a call to implement automated airport control systems. However, these control systems are disadvantageous because they focus primarily on the issue of runway incursion, and thus, are designed to alert the airport controllers when to stop or halt aircraft and/or ground vehicles from entering an active runway. In other words, conventional automated airport control systems indirectly inform the aircraft pilot only when to "stop" or halt ground-based based aircraft and/or vehicles. Secondly, the control systems are disadvantageous since they fail to focus on enhancing both airport safety and airport capacity.

SUMMARY OF THE INVENTION

In view of the foregoing, it is an object of the invention to provide an airport control system for enhancing airport capacity and airport safety.

It is another object of the invention to provide an airport control system for reducing airport runway incursions.

It is further object of the invention to provide an automated airport control system for controlling aircraft and ground traffic at an airport.

It is still another object of the invention to provide an automated airport control system adapted to forecast an optimum time for an aircraft to initiate a takeoff in order to be safely sequenced between successive landings on either crossing/intersecting runways or on the same/single runway.

It is yet another object of the invention to provide an automated airport control system that permits an aircraft takeoff position at an acute angle relative to the runway.

These, as well as other objects are achieved in providing an airport control system which includes a sensing mechanism for sensing a plurality of target conditions, a processing mechanism which receives the target conditions input from the sensing mechanism, and a plurality of visual displays in electronic communication with the processing mechanism which alerts a ground pilot when to "stop" or halt the aircraft in addition to alerting the pilot when to "go" or proceed on the taxiway in response to an electronic signal received from the processing mechanism. Hence, the airport control system in accordance with the present invention is capable of tracking inbound flights at an airport and forecast when each arrival will touchdown and/or cross intersecting runways.

In accordance with the present invention, the sensing mechanism is adapted to track a plurality of target conditions, such as at least one of the following: the position and velocity of inbound aircraft, the time from start of roll to the time of clearing an intersection of the aircraft awaiting takeoff, aircraft configuration (such as aircraft model), atmospheric conditions (i.e., temperature, visibility conditions, wake turbulence conditions, wind direction and velocity, barometric pressure, etc.), runways in use, and the distance from holding area to the intersecting runway. Other target conditions may also be included, such as mode of airport usage, i.e., whether the airports are subject to either takeoffs only, landings only, or interleaved takeoff and landing.

Preferably, land-based surveillance systems, such as radar, or air-based systems including GPS or other on-board navigation systems are provided to sense the target conditions. The system may also forecast, during a takeoff sequence, the time it takes for an aircraft to cross through an intersection. Information for this forecast may be derived from manufacturer performance data for the runway in combination with corrections for wind and temperature for the specific aircraft. Beacon associated techniques, such as the ATCRBS Beacon (ARTS), Bendix trilateration technique, Westinghouse™ interferometer and the MIT Precision Approach and Landing Monitor (PALM) systems may be employed to determine the position and velocity of approaching or inbound aircraft. The time from start of roll to the time of clearing an intersection of the aircraft awaiting takeoff may be determined from the type of aircraft, temperature and wind information. The type of aircraft is typically stored in flight strip information, which may be accessed electronically using a known system. In addition, the time from touchdown until the landing has exited the runway will be determined by the system, preferably by utilizing a manual tower position.

The sensed target conditions will be input into the processing mechanism, such as a computer or the like and includes an electronic controller. The computer preferably includes software capable of calculating the optimum time in which all aircraft awaiting departure may initiate a takeoff sequence based upon the sensed target conditions. The computer preferably includes a storage device adapted to retrievably store therein electronic files of information (i.e., target conditions) used in calculating the optimum take off window. Using a maximum likelihood filter, the computer filters the target condition to output a velocity for each aircraft on final approach to landing and place them in landing order. Using this information, the computer would then calculate the time that the next approaching aircraft is expected to cross the intersection (i.e., of intersecting runways) and, taking into account the estimated roll time of the holding aircraft, the controller outputs an electronic signal to the visual displays.

The visual displays, comprise a plurality of ground-based runway status lights, and an auxiliary display located in the control tower. Moreover, taxiway lights may be provided in locations where each taxiway crosses a runway. The visual displays preferably have three distinct colors, such as red, yellow (amber) and green. Upon receiving the electronic signal from the controller, the runway status lights and the visual display sends a visual signal, in the same manner as a traffic light, that alerts the ground pilots and airport controllers of the calculated optimum takeoff window. Accordingly, the airport control system is advantageous over conventional automated systems since these systems merely inform the aircraft pilot when to "stop" or halt the aircraft, while the runway status lights in accordance with the present invention alerts the aircraft pilot when to "stop" or halt the aircraft in addition to alerting the pilot when to "go" or proceed on the taxiway. Consequently, the "go" instruction is as important in achieving maximum airport capacity as the "stop" instruction is to increase airport safety. Without advising the pilots of both instructions, either airport safety or airport capacity will suffer.

At the same time, the present invention acknowledges the need to present similar information to the tower controller who must retain ultimate control over issuing aircraft directions. By advising pilots when to halt or proceed down the runway via the runway status lights, the pilot can expect a quicker reaction to the desired action. In addition, the use of the runway status lights, in combination with the visual displays in the control tower, provides a system that obviates the disadvantages of conventional radio communications system currently used in airports.

Moreover, the runway status lights provides the ground-based pilot information sufficient to enable him to initiate a takeoff exactly as calculated by the system, and thereby ensure a safe takeoff (i.e., no potential conflict with other landings or takeoffs) and at maximum capacity (i.e., minimum intervals between other aircraft). More particularly, the runway status lights are of a countdown-type in order to provide the pilots awaiting takeoff with information concerning when to expect a takeoff clearance as measured in seconds. For example, the runway status lights indicates using a solid yellow light that a specific takeoff clearance is expected to occur within a first predetermined time and a blinking or flashing yellow light to indicate that the specific takeoff clearance is expected to occur within a second predetermined time interval. A blinking or flashing green light indicates takeoff clearance is expected to occur at a third predetermined time interval, while a solid green light indicates that the aircraft may proceed with takeoff. For the taxiway lights, a red signal indicates that no access to the runway is permitted, a yellow signal indicates clearance to enter or cross the runway is expected within approximately 10 sec, and a green signal indicates authorization or approval is granted to enter or cross the active runway.

Moreover, the system will decide what is the appropriate (i.e., minimum) interval between a takeoff on a first runway and a landing on a second crossing runway and a takeoff on one runway and a landing on the same runway. This information is to be determined by the FAA and the tower controllers and may be varied depending upon environmental factors such as wind, weather, and visibility. The chosen intervals should be no more restrictive than the best controllers now use to separate landings from takeoffs. The system will decide what is the appropriate (i.e., minimum) taxi time to permit an aircraft to cross an active runway, and also decide what is the appropriate (i.e, minimum) interval between initiating the crossing action and the prior takeoff or landing, or subsequent takeoff or landing. The chosen interval should be approximately the same as those used by the best controllers in controlling aircraft.

Tower controllers will be provided with information concerning runway use which parallels the information being given to the pilots. The tower controller will have the option of negating a future aircraft takeoff window instruction to the pilot to either takeoff or enter/cross an active runway since, in all instances, at least a 10 second warning will be given (a flashing light) which will allow the controller with sufficient time to make a determination concerning the reasonableness of the indicated action.

When departure in-trail restrictions are applicable, such information will be provided to the system, which will ensure appropriate intervals between successive departures on the same outbound track to satisfy the in-trail restrictions. While the intrail restriction may be a hard or fixed number, the system may well treat it as a soft or variable number as determined to be reasonable by the tower controllers.

DETAILED DESCRIPTION OF THE INVENTION

Figure 1:
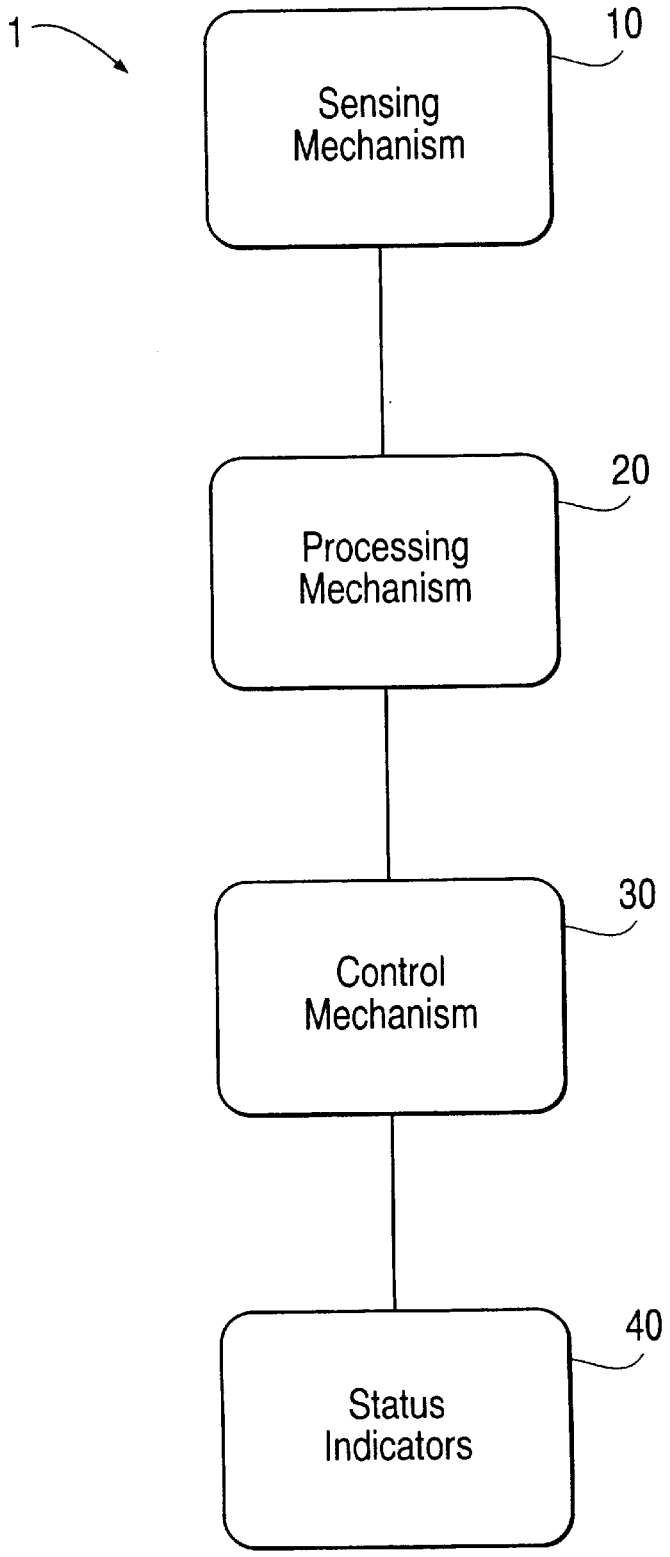
FIG. 1 is a block diagram of the airport takeoff window system.

Referring now to FIG. 1, in which an airport control system 1 is illustrated including a sensing mechanism 10 for sensing a plurality of target conditions, and a processing mechanism 20 electronically connected to the sensing mechanism for calculating an optimum time to initiate a takeoff sequence based upon the target conditions. Also included is a control mechanism 30 in electronic communication with the processing mechanism 20 and which controls/activates a set of status indicators 40 that provide runway status information to the control tower and ground-based aircraft and objects. The control mechanism 30 controls the status indicator 40 in response to receiving an electronic signal from the processing mechanism 20 regarding the optimum time interval in which takeoff may proceed.

Figure 2:
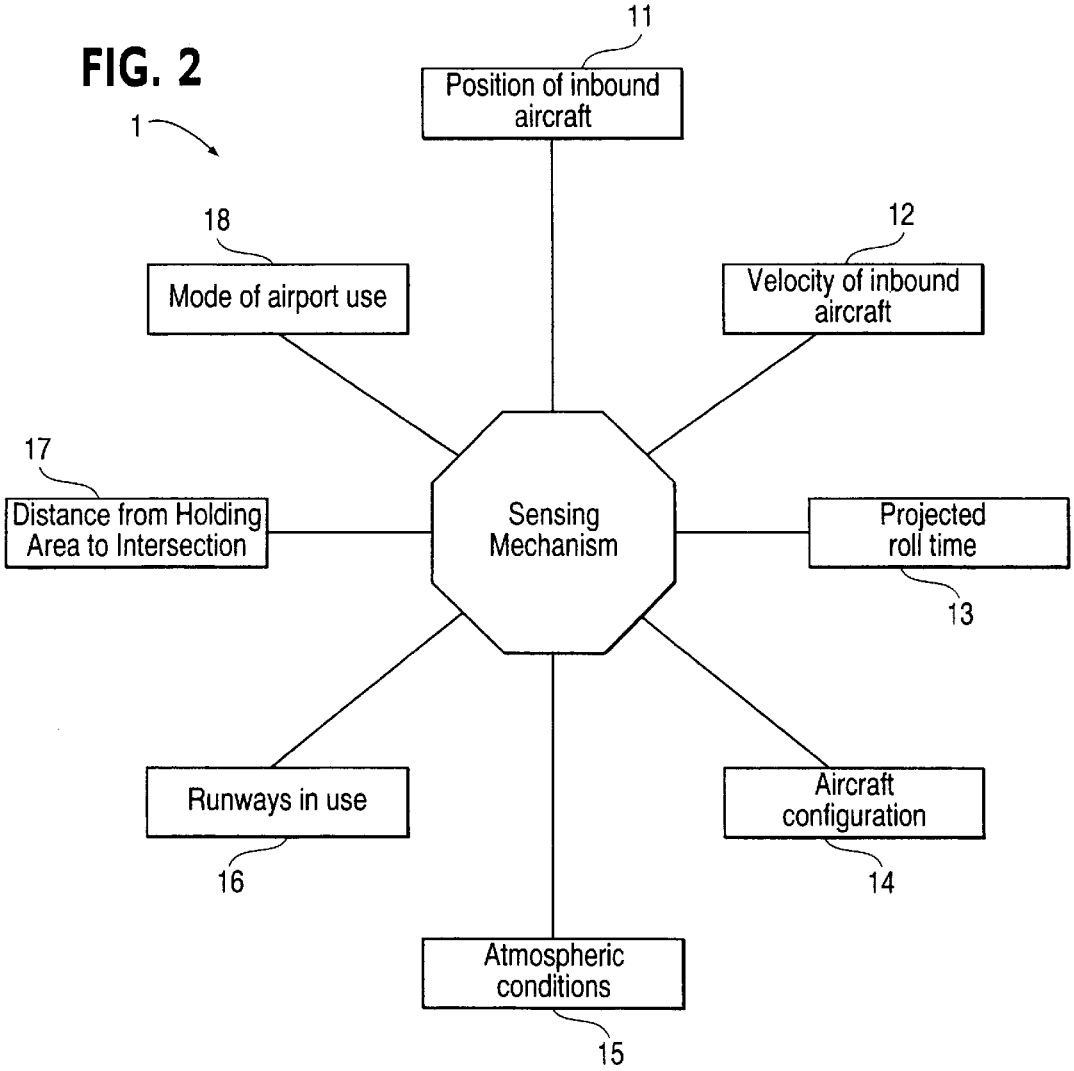
FIG. 2 is a block diagram of the sensing mechanism in accordance with the present invention.

As illustrated in FIG. 2, the sensing mechanism 10 is adapted to track a plurality of target conditions, such as at least one of the following types of sensors: a sensor 11 for sensing position of inbound aircraft to the airport, a sensor 12 for sensing a velocity of the inbound aircraft, a sensor 13 of the projected roll time (i.e., from the start of roll to the time of clearing an intersection of the aircraft awaiting takeoff), a sensor 14 for sensing aircraft configuration (such as aircraft model), a sensor 15 for sensing atmospheric conditions (such as temperature, visibility conditions, wake turbulence conditions, wind direction and velocity, barometric pressure, etc.), a sensor 16 for sensing which runways are in use, a sensor 17 for sensing the distance from holding area to the intersecting runway, and a sensor 18 for sensing a mode of airport use, i.e., whether the airports are subject to either takeoffs only, landings only, or interleaved takeoff and landing.

Preferably, the sensing mechanism 10 comprises at least one of a land-based surveillance systems, such as radar, an air-based system, GPS, or on-board navigation systems. The system 1 is adapted to also forecast, during a takeoff sequence, the time it takes for an aircraft to cross through an intersection. Information for this forecast may be derived from manufacturer performance data for the runway in combination with corrections for wind and temperature for the specific aircraft. Beacon associated techniques, such as the ATCRBS Beacon (ARTS), Bendix trilateration technique, Westinghouse™ interferometer and the MIT Precision Approach and Landing Monitor (PALM) systems may be employed to determine the position and velocity of approaching or inbound aircraft. The time from start of roll to the time of clearing an intersection of the aircraft awaiting takeoff may be determined from the type of aircraft, temperature and wind information. The type of aircraft is typically stored in flight strip information, which may be accessed electronically using a known system. Note that obtaining accurate aircraft position information can be obtained through a variety of sources. Initially, it is probable that a position in the control tower at busy airports should be dedicated largely to this function (essentially using the status indicators 40 to give taxiing clearances rather than using congested radio channels). As more sophisticated aircraft position information becomes available, the system 1 can sense aircraft position from such radar or imbedded detection systems.

The sensed target conditions are subsequently input into the processing mechanism 20, which may comprise a computer or the like which is in electronic communication with the control mechanism 30 for controlling the status indicators 40. The processing mechanism 20 may comprise an input device (not shown) and an output device (not shown). Input devices can include a mouse, a keyboard or the like, while the output device is preferably a display device such as a monitor or a liquid crystal display (LCD) screen. Of course, other input and output devices can also be used in accordance with the present invention. The processing mechanism 20 may include a maximum likelihood filter for filtering the target conditions input thereto, and software capable of making the necessary calculations, i.e., the optimum time in which all aircraft awaiting departure may initiate a takeoff sequence based upon the sensed target conditions. The processing mechanism 20 may further include a storage device adapted to retrievably store therein electronic files of information, such as the target conditions, used in calculating the optimum take off window.

In operation, upon receiving the target conditions from the sensing mechanism 20, the maximum likelihood filter of the processing mechanism 10 functions so as to filter the target conditions, and outputs a velocity for each aircraft on final approach to landing and place them in landing order. By the use of this information, the processing mechanism 10 then calculates the time that the next approaching aircraft is expected to cross the intersection (i.e., of intersecting runways) and, taking into account the estimated roll time of the holding aircraft, the control mechanism 30 outputs an electronic signal to the status indicators 40 to thereby activate the light signals. Note, that the control mechanism 20 may be manually overridden by the controller in the control tower, who is given the authority disregard the recommendation of the control mechanism 20 in issuing an alternative command to the ground vehicles.

Figure 3:
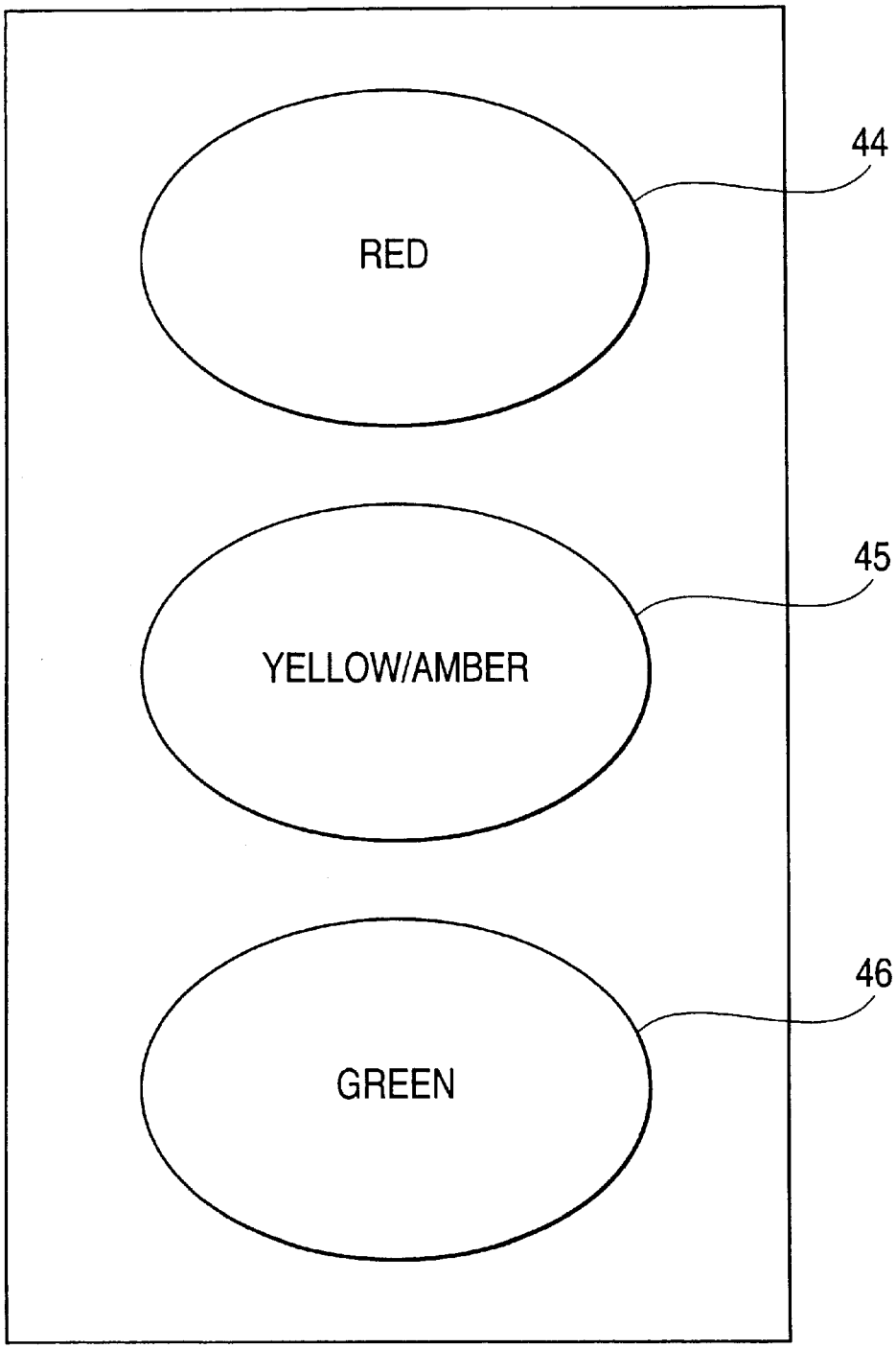
FIG. 3 is a block diagram of the status indicators.

As illustrated in FIG. 3, in accordance with the preferred embodiment of the invention, the status indicator 40 comprises a set of runway light displays 41 located adjacent to the surface of the runway, a control tower display 42 located within the control tower, and a set of taxiway displays 43 positioned at locations where a taxiway crosses or intersects a runway. Once activated by the control mechanism 20, the status indicators 40 emits one of three distinct colors, such as red, yellow (amber) and green. In this regard, a red signal indicates essentially that no access to the runway is permitted, a yellow (amber) signal indicates essentially that clearance to enter or cross the runway is expected within approximately 10 sec, while a green signal indicates essentially that authorization or approval is granted to enter or cross the active runway.

Figure 4:
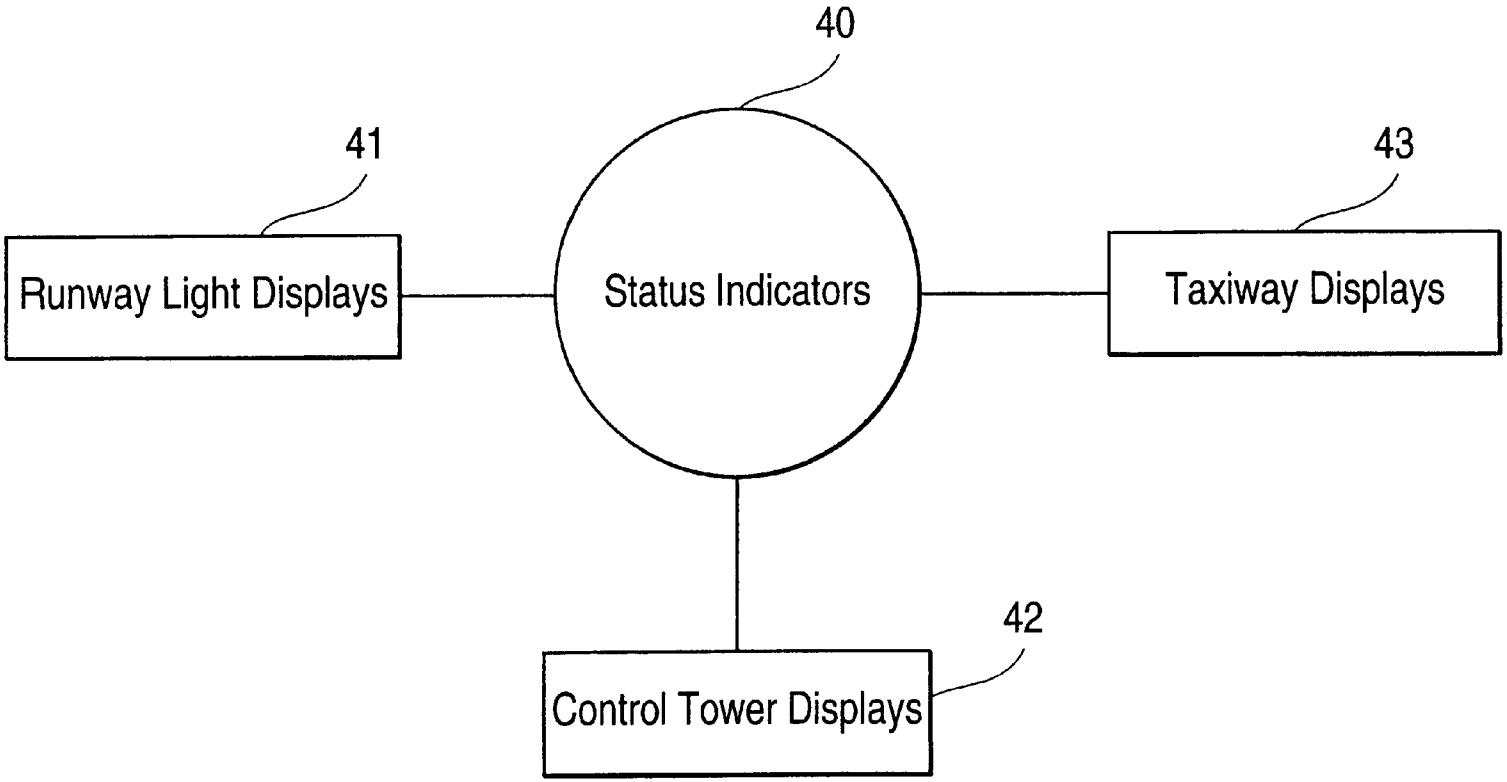
FIG. 4 is a front view of status indicators in accordance with the present invention.

As shown in FIG. 4, the control tower displays 42 may comprise a monitor, a liquid crystal display (LCD) screen, or any device capable of emitting a light signal. Preferably, the runway status display 41 and the taxiway display 43 each comprise a plurality of incandescent light signals 44, 45, 46 which employ either LED or neon light source technology for generating color signals (red, yellow/amber and green) in response to receiving electronic signals from the control mechanism 30. The light signals 44, 45, 46 may comprise a signal head (i.e., a single circular indication) including an incandescent filament lamp, surrounded by a reflector and fitted with a colored glass lens. Preferably, a shape of the reflector and the optical properties of the lens that best distribute luminous intensity should be used. In essence, the runway status display 41 and the taxiway display 43 may each take the form of a conventional traffic signal device.

In operation, upon receiving an electronic signal from the control mechanism 30, the status indicator 40, i.e., the runway status lights, the taxiway lights and the control tower display, each produces a visualized signal, in the form of red, yellow/amber or green light, which alert the ground pilots and airport controllers of the calculated optimum takeoff window. Note that the default condition of the status indicator 40 is red. Hence, the red light signal 44 will be activated to confirm that the runway is inactive for a specified period of time until another light signal is activated. For example, the status indicator 40 indicates that takeoff clearance is expected at a first predetermined time interval by activating the solid yellow (amber) light signal 45. The first predetermined time interval may be any time interval which is chosen by the control tower, but is preferably not more than approximately 20 sec in length.

The status indicator 40 indicates that takeoff clearance is expected at a second predetermined time interval by providing an intermittent or flashing yellow (amber) light signal 45. As in the case of the first predetermined time interval, the second predetermined time interval may be any time interval chosen by the control tower, but is approximately 10 to 19 sec in length, but preferably, approximately 10 sec. The status indicator 40 indicates that takeoff clearance is expected at a third predetermined time interval by providing an intermittent or flashing green light 46. The third predetermined time interval may be any time interval chosen by the control tower, but is preferably less than 10 sec in length. Finally, the status indicator 40 indicates that the vehicle or aircraft may proceed through the runway by turning the green light signal 46 from intermittent radiance to a solid radiance.

Hence, through the light signals 44, 45, 46, both the ground-based aircraft pilot (or vehicle) and the control tower are placed are given a visual indication concerning when to "stop"/halt the aircraft or when to "go"/proceed along the taxiway. Consequently, the ability of the light signals 44, 45, 46 to issue either a "halt" or "go" instruction is essential in achieving maximum airport capacity as the "stop" instruction is to increase airport safety. Without advising the pilots of both instructions, either airport safety or airport capacity will suffer.

Figure 5:
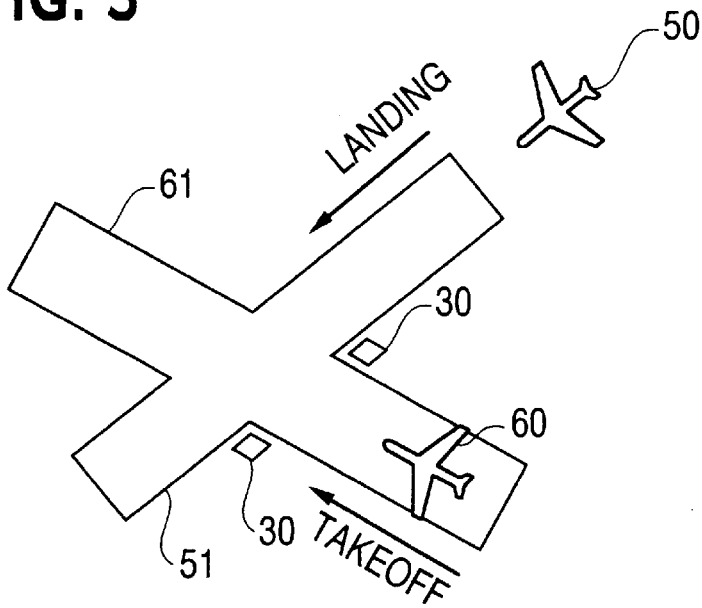
FIG. 5 illustrates an airport ground conflict scenario involving intersecting runways.

FIG. 5 shows a scenario in which a first aircraft 50 intends to land on a first runway 51 while a second aircraft 60 intends to takeoff on a crossing or intersecting runway 61. In order to prevent a collision or near-miss between the aircraft 50, 60, the system 1 performs the following calculations and issues the appropriate instructions. Initially, the sensing mechanism 10 senses a series of target conditions, such as position and velocity of the inbound aircraft 50. The processing mechanism 20 receives the sensed target data in the form of an electronic signal from the sensing mechanism 10 and calculates an estimated time remaining before touchdown of the inbound aircraft 50 based upon the sensed target conditions. The processing mechanism 20 estimates a time interval from touchdown of the aircraft 50 until it crosses the intersection between the runways 51, 61, and then adds this time interval to determine an estimated time of when the aircraft 50 will enter the intersection. As previously mentioned, information for this calculation may be derived from manufacturer performance data for the runway in combination with corrections for wind and temperature for the specific aircraft. Again, beacon associated techniques, such as the ATCRBS Beacon (ARTS), Bendix trilateration technique, Westinghouse™ interferometer and the MIT Precision Approach and Landing Monitor (PALM) systems may be employed to determine the position and velocity of approaching or inbound aircraft.

Thereafter, the processing mechanism 20 projects an estimated takeoff roll time for the aircraft 60 to cross through the intersection. At a point before the first aircraft 50 crosses through the intersection, the processing mechanism 20 estimates at what time during the landing of the inbound aircraft 50 may the second aircraft 60 be cleared for takeoff. Preferably, this time interval is to be determined by the FAA and in accordance with the practice utilized by the most proficient controllers. The processing mechanism 20 then determines, using the sensed target conditions, at what point has a previous takeoff occurred on the runway 61 in order to ensure that the clearance for takeoff of the aircraft 61 does not occur within at least a predetermined time interval proscribed by the FAA and in accordance with the practice utilized by the most proficient controllers.

Next the sensing mechanism 10 senses whether the takeoff of the aircraft 61 is restricted by any in-trail restrictions relative to the previous takeoff. This ensures that the subsequent takeoff is not in violation of the in-trail restriction. Preferably, this is accepted as a soft or variable time restriction subject to a variation of a predetermined time interval from the actual limit. Based upon the sensed in-trail restriction, the processing mechanism 20 next calculates an estimated time of landing to thereby ensure that the takeoff will have a minimum time interval before the next landing. Again, this time interval is to be determined by the FAA and in accordance with the practice utilized by the most proficient controllers.

At a predetermined time before the processing mechanism 20 calculates the estimated time window of when the next takeoff should occur, the control mechanism 30 activates a "standby" light, i.e., a solid yellow (amber) light 45, on the runway light display 41 and the control tower display 42. At a predetermined time before the processing mechanism 20 projects when a subsequent takeoff will be permitted, the control mechanism 30 activates a "caution" light, i.e., a flashing yellow (amber) light 45 on the runway light display 41 and the control tower display 42. Finally, at a predetermined time before the processing mechanism 20 calculates when the next takeoff is permitted, the control mechanism 30 activates a final "countdown" light, i.e., a flashing green light 46, subsequently ending with a final "green" light indicating takeoff approval.

In accordance with present invention, the system has fall-back provision which gives the control tower the authority to override the system 1 and instead activate a halt or stop signal, i.e., a red light 44, in order to abort or terminate the proposed takeoff, or a caution signal, i.e., a yellow (amber) light 45, if it is desired to merely delay the takeoff.

Figure 6:
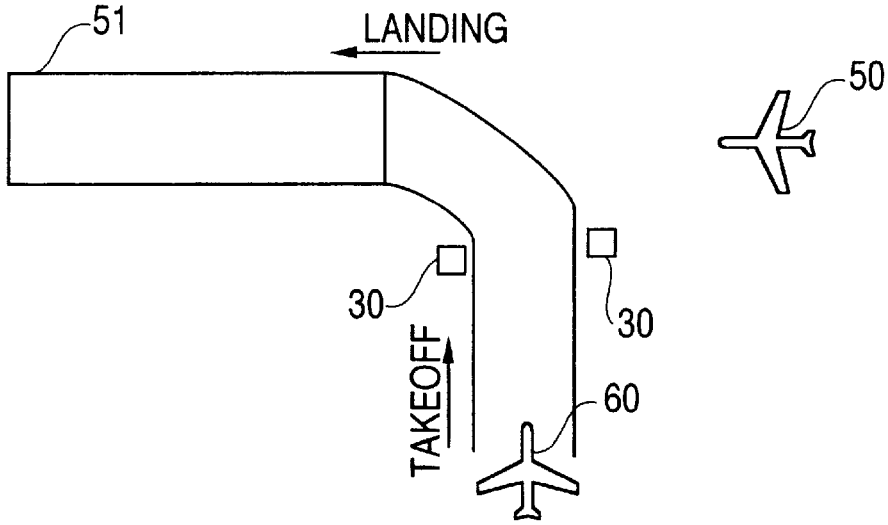
FIG. 6 illustrates an airport ground conflict scenario involving a single runway.

FIG. 6 shows a scenario in which a first aircraft 50 attempts to land on a runway 51 while a second aircraft 60 intends to takeoff on the same runway 51. In order to prevent a collision or near-miss between the aircraft 50, 60, the system 1 performs the following calculations and issues the following instructions. Initially, target conditions such as the location and speed of the landing aircraft 50 are acquired in order to calculate the time remaining before touchdown. Next, a determination is made concerning whether sufficient time exists to allow takeoff of the second aircraft 60 before the landing of the first aircraft 50. If this determination is affirmative, confirmation is made to determine if an aircraft involved in a prior landing remains on the runway 61. If the aircraft is not on the runway, a determination is made concerning when the last takeoff occurred and whether the upcoming takeoff of the aircraft 60 will have at least a second time interval or an appropriate in-trail restriction interval (if applicable). If both conditions are satisfactory (or will be satisfactory within a certain amount of time), the status indicators 30 (i.e., the runway countdown lights) are activated to thereby permit an expedited takeoff of the aircraft 60 once all of the necessary conditions are satisfied. If any of the aforementioned intervals do not meet the necessary requirements, the situation is reassessed (preferably every 1–2 sec) until all conditions are satisfactorily met. The runway countdown lights are activated when all criteria are satisfied.

Figure 8:
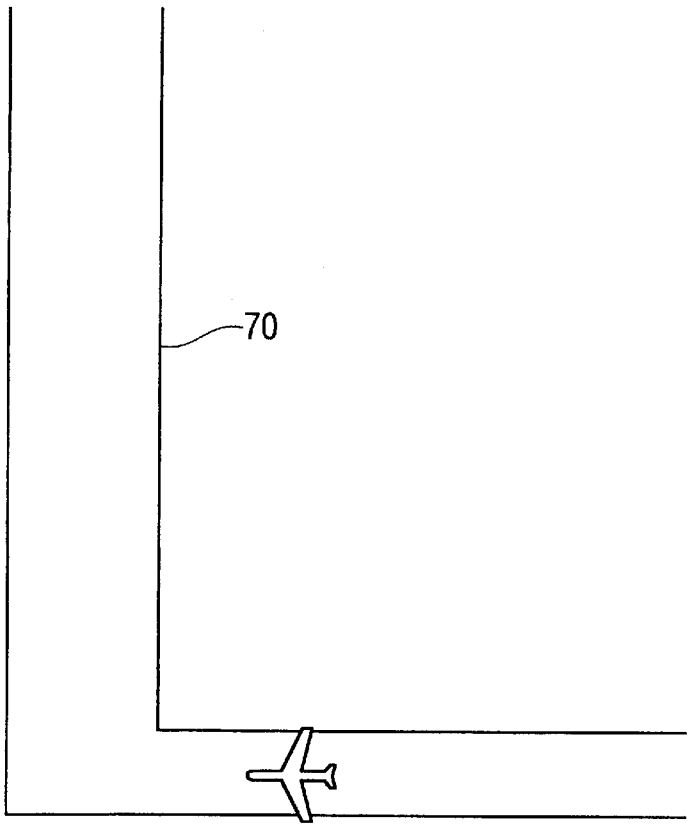
FIG. 8 illustrates a conventional taxiway design having a 90 degree turn for takeoff.

In this scenario, the aircraft 60 awaiting takeoff clearance is held on an angled taxiway at an approximately 45 degree angle relative to the active runway. Once clearance for takeoff has been indicated (using the flashing green light signal), the aircraft 60 will expedite its takeoff using a rolling takeoff procedure. The angled roll off technique is advantageous over a conventional 90 degree angle runway 70 (See FIG. 8) since it saves at least approximately 15 sec of runway occupancy time with each takeoff. In addition, such a takeoff saves the potential loss of one takeoff slot when separation margins are minimal without a hazard potential, i.e., an aircraft sitting on the runway awaiting takeoff clearance. The 45 degree angled "hold" position also significantly minimizes the chance of collisions between the landing aircraft 50 and the aircraft 60 attempting to takeoff if the landing aircraft inadvertently lands on the takeoff runway 61.

Under visual flight rule (VFR) conditions, takeoffs and landings on closely spaced parallel runways are essentially independent of one another, but as weather/visibility worsen under instrument flight rule (IFR)conditions, the takeoffs become dependent upon the landings to ensure separation in the event of a missed approach and to ensure that the landing will land on the landing runway instead of on the takeoff runway. Under these marginal IFR conditions, the system 1 can assist with both safety and capacity objectives as follows. Initially, the system 1 tracks the landing aircraft 50 in order to determine where and when the landing pilots have the landing runway 51 in sight, i.e., when a landing is capable of being performed, and thus, also when a takeoff of an aircraft 60 can occur. The system 1, therefore, is capable of projecting when takeoff clearance is permitted and give advance warning of such instructions via the runway status lights. When all separations have been adequately ensured, the system 1 will active the runway status lights.

Figure 7:
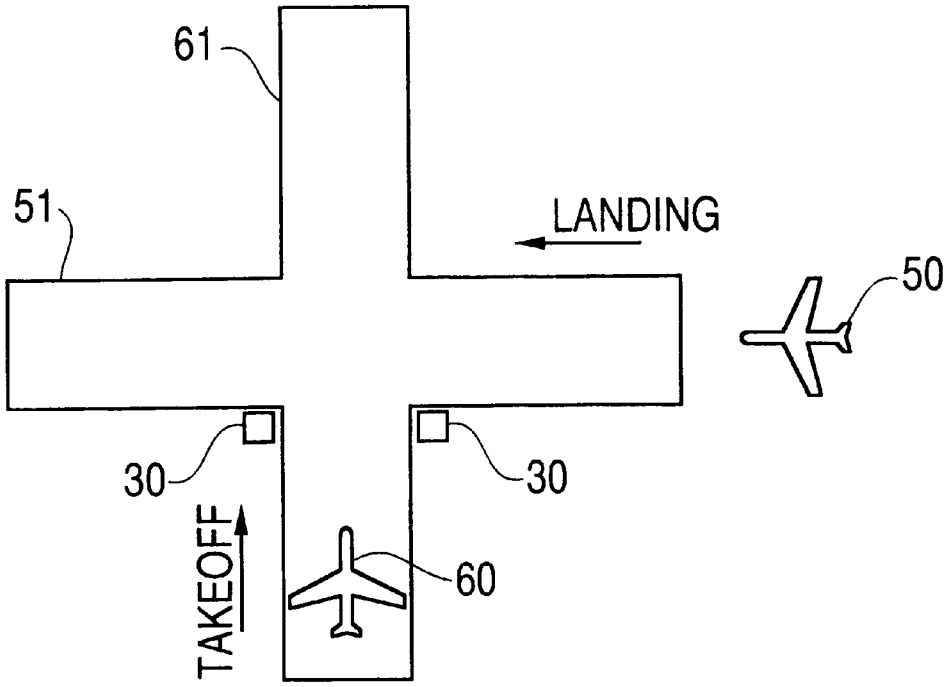
FIG. 7 illustrates an airport ground conflict scenario involving a landing on one runway and hold short position of an aircraft on a crossing or intersecting runway.

As illustrated in FIG. 7, in a scenario in which an approaching aircraft 50 attempts to land on a first runway 51 and a second aircraft 60 is positioned to hold short of a crossing runway 61. In this scenario, there is an attempt by the control tower and pilots to operate both landings and takeoffs independent of one another by requiring the landing aircraft 50 to land but hold short of the takeoff runway 61. In this regard, the system 100 assists in minimizing the conflict potential of landing on one runway 51 and taking off on a crossing runway 61. In assessing the time interval required from touchdown of the aircraft 50 to reach the intersection, note that the landing roll time of the second aircraft 60 can vary significantly depending upon conditions such as wind, runway surface condition (i.e., rain or snow or the like), and the intent of the pilot, i.e., whether the pilot of the approaching aircraft 50 is attempting to stop the aircraft 50 before the intersection, or, under marginal wind/weather/surface conditions, has the pilot elected to go through the intersection because of unfavorable surface conditions. In this regard, the appropriate landing rolling time for use by the system 1 should have both a minimum and maximum time describing the two extreme conditions.

In a scenario in which the control tower must allow an aircraft to cross an active runway, there are frequent delays and congestion primarily due to the taxiing aircraft, but also, occasionally to another aircraft landing or taking off when the control tower increases their separation in order to cross the taxiing aircraft. This can be the result of a combination of things, such as communications congestion, taxiing aircraft receiving lesser priorities than the landings or takeoffs, or a backlog of either landings or takeoffs who receive the priority. Under these circumstances, the system 1 can assist in expediting aircraft across the active runway by performing the following functions.

When the crossing taxiway is very close to the landing touchdown point, the processing mechanism 20 may project, using such target conditions as aircraft position and speed, when the landing aircraft 50 will cross through the intersection. Or, in the case of when one aircraft is on a takeoff runway and a second aircraft is on a crossing taxiway and is also very close to the start of a takeoff roll, the processing mechanism 20 may project when the next takeoff will cross through the intersection. The processing mechanism 20 may also determine the appropriate time for the taxiing aircraft to cross a runway to thereby ensure that there is sufficient separation between the taxiing aircraft and the next landing or takeoff aircraft. Before the next takeoff or landing aircraft crosses through the taxiway intersection, the control mechanism 30 activates the taxiway light to a "yellow" condition to warn the taxiing pilot of an imminent crossing permission. At an appropriate time, the control mechanism 30 activates the taxiing light to a "green" condition to authorize clearance to cross the active runway.

For scenarios in which closed taxiway activity is apparent due to an active runway being in use, the system 1 easily identifies when a runway is or will be "active", and therefore, can prohibit aircraft and/or ground vehicles from entering the runway as follows. The system 1 will recognize when a landing will occur within a predetermined time period. Since the default light condition of red (signifying halt or stop), it will take a positive indication of runway non-use for the control mechanism 30 to change the red light to a different color (green or yellow). Once the system 1 receives indication that an aircraft on the taxiway is waiting for clearance to cross, the processing mechanism determines if sufficient time is available for the aircraft to cross the runway based upon separation from the next landing or takeoff time to cross the runway it will light the appropriate taxiway display 43 . The system 1 may receive this indication from any of a variety of sources, such as directly from the tower controller or through the sensing mechanism 10. The control mechanism 30 may also control a second set of runway edge lights which would be designed to flash a warning light (red or yellow) when there will be a landing or takeoff within the a predetermined time interval (in seconds), thereby warning any ground vehicle or aircraft to exit the active runway as quickly as possible.

The system 1 is flexible in that it may used at airports that are not equipped with control towers. In such a case, in order to provide a reasonable degree of surveillance and protection to aircraft operating at airports without control towers, a smaller self-contained system 1 may be used and includes a radar system for aircraft identification and detection, runway lights for directing the pilots, a computer algorithm configured for the airport in question and sufficient performance data to reflect typical aircraft operation at that airport. Note that, since there would not be any controllers on duty, such a system 1 would not be equipped with controller overrides.

Figure 9:
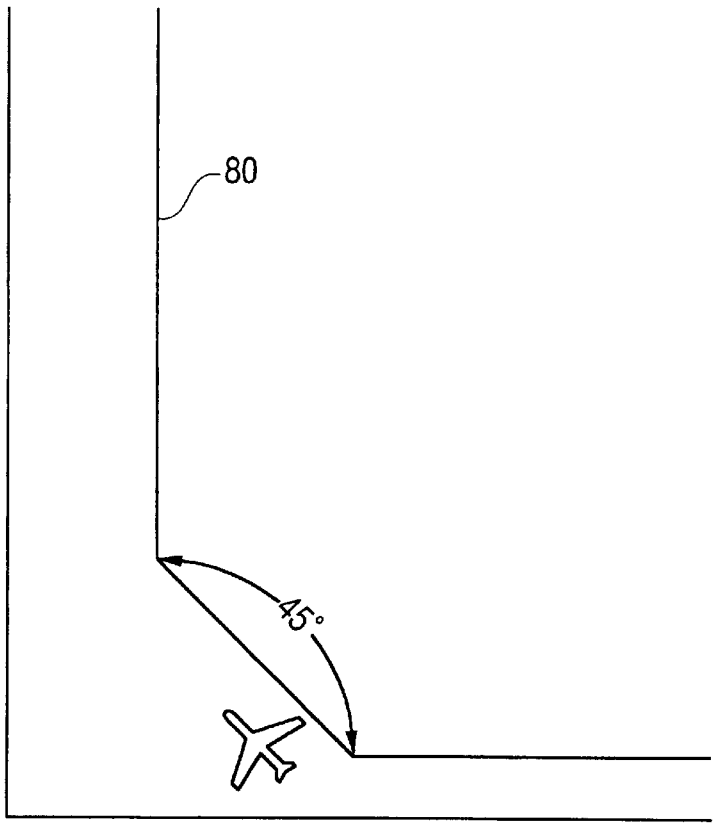
FIG. 9 illustrates a taxiway design in accordance with the present invention.

In another embodiment shown in FIG. 9, the system 1 may be directed to reducing runway occupancy time by providing a redesign of taxiway geometry. Runway occupancy time is important since it is considered a determinant of airport capacity, and thus, the proposed runway design significantly reduces runway occupancy time with a resulting increase in airport capacity. This is achieved in providing an angled taxiway 80 that permits an aircraft awaiting clearance for takeoff to wait at an approximately 45 degree angle relative to the active runway, to thereby execute a "rolling takeoff" once the command for takeoff is given by the runway lights. This design provides several advantages over conventional runway designs. First, the use of a rolling takeoff serves to reduce runway occupancy time, and hence, increase runway capacity. Second, since the waiting aircraft is not waiting on the active runway for clearance to takeoff, there is a greatly reduced chance of a collision between the waiting takeoff and some other landing on that same runway. Last, the angled taxiway 80 may also be used as a higher-speed exit taxiway for landing aircraft when they must exit at the last taxiway, with further reductions to runway occupancy time.

Figure 10:
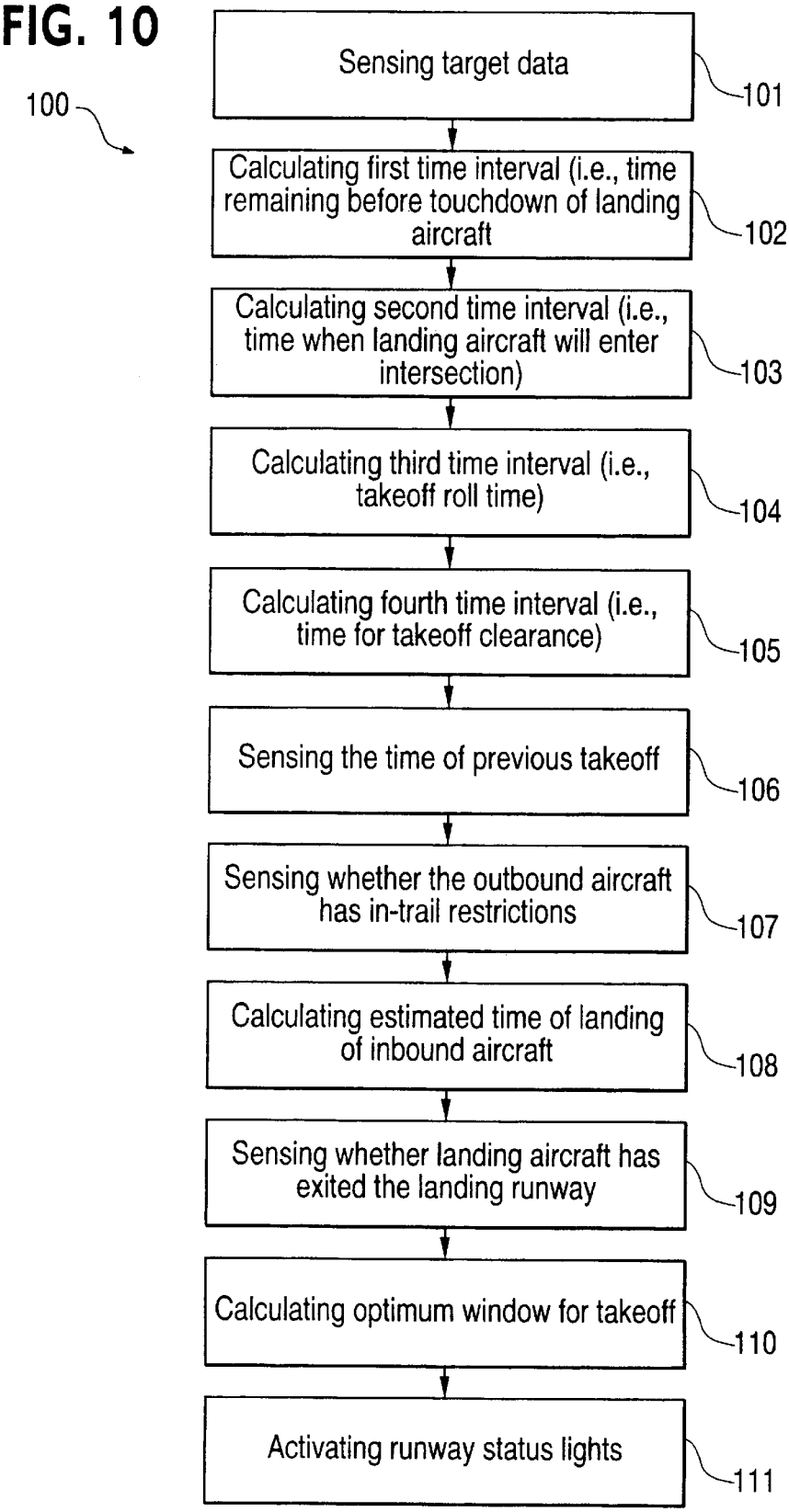
FIG. 10 illustrates a flow chart showing a method of preventing a collision or near-miss between a first aircraft landing on a first runway and a second aircraft taking off on a second runway which crossing or intersects the first runway.

FIG. 10 illustrates an embodiment of the invention in which a method 100 for controlling airport ground traffic in which an outbound aircraft awaits takeoff on a runway and an inbound aircraft attempts to land on an intersecting runway. Note that this method essentially mimics the scenario described hereinabove. The initial step, described in the FIG. 10 as step 101, the sensing mechanism 10 senses a series of target conditions, such as position and velocity of the inbound aircraft 50. The processing mechanism 20 receives the sensed target data in the form of an electronic signal from the sensing mechanism 10 and calculates an estimated time remaining before touchdown of the inbound aircraft 50 based upon the sensed target conditions. In step 102, the processing mechanism 20 receives the sensed target data from the sensing mechanism 10 and calculates a first time interval ($t_1$) representing the time remaining before touchdown of the inbound aircraft. In step 103, the processing mechanism 20 calculates, using sensed target conditions from the sensing mechanism 10, a second interval ($t_2$) representing a projecting time from touchdown that it takes the second aircraft to cross through the intersection. The second time interval ($t_2$) is subsequently adding to the first time interval ($t_1$) to determine an estimated time ($t_{est}$) of when the landing aircraft will cross the intersection. As previously mentioned, the sensed target conditions used to calculate ($t_t$) may be derived from manufacturer performance data for the runway in combination with corrections for wind and temperature for the specific aircraft.

In step 104, the processing mechanism 20 calculates a time interval ($t_3$) representing an appropriate takeoff roll time for the next takeoff to cross through the intersection. In step 105, the processing mechanism 20 calculates a fourth time interval ($t_4$) representing a time frame during the landing of the second aircraft can the first aircraft be cleared for takeoff. This point represents a time value that occurs before the second aircraft actually crosses through the intersection. The time value should be determined by the FAA and in accordance with the practice utilized by the most proficient controllers. Next, in step 106, the processing mechanism 20 determines when a previous takeoff on the runway has occurred in order to ensure that clearance for takeoff of the first aircraft does not conflict within at least a predetermined time interval determined by the FAA in accordance with the practice utilized by the most proficient controllers.

In step 107, the processing mechanism 20 determines whether the takeoff of the outbound aircraft is restricted by any in-trail restrictions relative to the previous takeoff. This ensures that the subsequent takeoff is not in violation of the in-trail restriction. Preferably, this is accepted as a soft or variable time restriction subject to a variation of a predetermined time interval from the actual limit. In step 108, the processing mechanism 20 calculates an estimated time in which the inbound aircraft lands to thereby ensure that takeoff of the first aircraft will have a minimum time interval before the next landing. Again, this time interval should be determined by the FAA in accordance with the practice utilized by the most proficient controllers.

Next, in step 109, the sensing mechanism 10 senses whether the landing aircraft has exited the landing runway. In step 110, based upon the sensed target conditions, the optimum takeoff time window is calculated. Finally, in step 111, and in response to the calculated optimum takeoff time window, the control mechanism 30 activates the status indicators 40 indicating the estimated optimum time window in which to takeoff from the airport.

The exemplary embodiments of the present invention offers advantages over conventional airport control systems. By providing a processing mechanism adapted to process the various target conditions, optimized decision concerning when to schedule the next takeoff, when to permit an aircraft to cross an active runway, and when to permit or deny entrance to an active runway is realized. Accordingly, overall airport safety is enhanced since the system 1 ensures adequate separation between landings and takeoffs.

Moreover, the system 1 ensures that no aircraft or ground vehicles will enter an active runway. Such a system will further ensure that aircraft will no longer await takeoff clearance while sitting on an active runway. Capacity is enhanced since the system 1 utilizes minimum reasonable separation standards when determining the time in which it is safe to permit the next movement, thus, mimicking the best air traffic controllers. The system 1 also provides pilots with additional guidance so that they will be able to react more quickly to takeoff commands and will reduce runway occupancy times and hence increase aircraft movement rates.

Although exemplary embodiments of the present invention have been described in detail herein, it should be appreciated by those skilled in the art that many modifications are possible without materially departing from the spirit and scope of the teachings and advantages which are described herein. Accordingly, all such modifications are intended to be included within the spirit and scope of the present invention as defined by the appended claims.

What is claimed is:

1. A system for automating the timing and sequencing of takeoffs from an airport of a plurality of piloted, ground based, outbound aircraft to achieve optimum airport efficiency while promoting safety by insuring an adequate amount of spacing from a plurality of airborne, incoming aircraft, comprising A. a sensing mechanism including a plurality of sensors for sensing a plurality of target conditions including the position and velocity of all incoming aircraft and for generating target condition signals representative of the sensed target conditions, B. a processing mechanism connected with said sensing mechanism for generating from the target condition signals a plurality of separate takeoff signals for indicating corresponding time intervals during which takeoff sequences for the outbound aircraft can be initiated, respectively, to achieve desired efficiency and safety, and C. a status indicator connected with said processing mechanism to receive said takeoff signals to produce, without human intervention, an indication in real time, to the pilots of the corresponding outbound aircraft, of a takeoff clearance interval during which it is safe and desirable to initiate the takeoff of each outbound aircraft;

whereby the takeoff of aircraft from an airport can be optimized both for safety and efficiency by conveying automatically to the pilots of a plurality of outbound aircraft, without the intervention of human judgment, takeoff signals indicating intervals during which takeoff should be initiated.

2. The system of claim 1 further including a plurality of status indicators, wherein said status indicators comprises a plurality of runway light displays, control tower displays and taxiway light displays, said runway light displays and taxiway light displays lights being positioned adjacent the surface of the airport runway.

3. The system of claim 2, wherein said status indicators include a red light signal which are continuously illuminated to indicate that movement on the runway is prohibited.

4. The system of claim 3, wherein said status indicators include a yellow light which is continuously illuminated to indicate that a takeoff clearance is expected at a first predetermined time interval.

5. The system of claim 4, wherein said first predetermined time interval is approximately 20 sec.

6. The system of claim 5, wherein said yellow light is intermittently illuminated to indicate that the takeoff clearance is expected at a second predetermined time interval.

7. The system of claim 6, wherein said second predetermined time interval is approximately 10 sec.

8. The system of claim 7, wherein said status indicators include a green light which is intermittently illuminated to indicate that the takeoff clearance is expected at a third predetermined time interval.

9. The system of claim 8, wherein said third predetermined time interval is less than 10 sec.

10. The system of claim 9, wherein said green light may be continuously illuminated to indicate that the aircraft and the ground objects may proceed through an active runway and that an outbound aircraft may initiate takeoff from the airport runway.

11. The system of claim 2, wherein said taxiway display lights includes a yellow light which indicates an imminent crossing permission.

12. The system of claim 11, wherein said taxiway lights includes a green light which indicates clearance to cross an active runway.

13. The system of claim 12, wherein said taxiway lights includes a red light to which indicates the non-entry into an active runway.

14. The system of claim 1, wherein said target conditions further include at least one of a time from start of roll to the time of clearing an intersection of the aircraft awaiting takeoff, inbound and outbound aircraft model, temperature, visibility conditions, wake turbulence conditions, wind direction, wind velocity, barometric pressure, runways in use, and the distance from holding area to the intersecting runway.

15. The system of claim 1, wherein said processing mechanism includes a manual override function that permits a control tower at the airport to disable the transmitted electronic signal from the processing means.

16. The system of claim 1, wherein said sensing mechanism comprises a land-based surveillance system, an air-based surveillance system, or an on-board navigation system.

17. A method for automating the timing and sequencing of takeoffs from an airport of a plurality of piloted, ground based, outbound aircraft for achieving optimum airport efficiency while promoting safety by insuring an adequate amount of spacing from a plurality of airborne inbound aircraft, comprising the steps of A. a sensing a plurality of target conditions including the position and velocity of all inbound aircraft, B. generating target condition signals representative of the sensed target conditions, C. procesing the target condition signals to generate therefrom a plurality of separate takeoff signals for indicating corresponding time intervals during which takeoff sequences for the outbound aircraft can be initiated, respectively, to achieve desired efficiency and safety, and D. producing, via implementation of a computer program using the takeoff signals, to produce, without human intervention, an indication in real time, to the pilots of the corresponding outbound aircraft, the interval during which it is safe and desirable to initiate the takeoff of each outbound aircraft;

whereby, the takeoff of aircraft from an airport can be optimized both for safety and efficiency by eliminating the need to rely upon human judgment, with attendant chance of error, by conveying automatically to the pilots of a plurality of outbound aircraft indications of when takeoff sequences should be initiated.

18. The method of claim 17, wherein said producing step includes calculating an estimated time remaining before touchdown of the inbound aircraft based upon said sensed target conditions.

19. The method of claim 18, wherein said producing step includes calculating a first time interval representing a time remaining before touchdown of the inbound aircraft.

20. The method of claim 19, wherein said producing step includes calculating a second time interval representing a projecting time from touchdown that it takes the second aircraft to cross through a possible intersection in the path of travel of the inbound and outbound aircraft.

21. The method of claim 20, wherein said producing step includes producing an estimated time of when the inbound aircraft will cross the intersection based on said first and second time intervals.

22. The method of claim 21, wherein said producing step includes calculating a time interval representing an appropriate takeoff roll time for the next outbound aircraft taking off to cross through the intersection.

23. The method of claim 22, wherein said producing step includes calculating a time interval during the landing of the inbound aircraft in which the outbound aircraft can be cleared for takeoff.

24. The method of claim 23, wherein said step includes calculating an estimated time in which the inbound aircraft lands to thereby ensure that takeoff of the outbound aircraft will have a minimum time interval before the next landing.

25. The method of claim 17, wherein said sensing step includes sensing when an aircraft that had previously taken off has occurred in order to ensure that clearance for takeoff of the outbound aircraft does not conflict within at least a predetermined time interval.

26. The method of claim 25, wherein said sensing step includes sensing whether takeoff of the outbound aircraft is restricted by any in-trail restrictions relative to an aircraft that had previously taken off.

27. The method of claim 26, wherein said sensing step includes sensing whether the inbound aircraft has exited the landing runway.

* * * * *